US009702553B2

(12) United States Patent
Sato et al.

(10) Patent No.: US 9,702,553 B2
(45) Date of Patent: Jul. 11, 2017

(54) WASTE MATERIAL SUPPLY DEVICE AND WASTE MATERIAL PROCESSING DEVICE

(75) Inventors: Jun Sato, Tokyo (JP); Yoshihisa Saito, Yokohama (JP); Toshimasa Shirai, Yokohama (JP); Norio Yoshimitsu, Yokohama (JP); Yasunori Terabe, Yokohama (JP)

(73) Assignee: MITSUBISHI HEAVY INDUSTRIES ENVIRONMENTAL & CHEMICAL ENGINEERING CO., LTD., Yokohama-shi (JP)

( * ) Notice: Subject to any disclaimer, the term of this patent is extended or adjusted under 35 U.S.C. 154(b) by 506 days.

(21) Appl. No.: 14/001,829

(22) PCT Filed: Mar. 28, 2011

(86) PCT No.: PCT/JP2011/057704
§ 371 (c)(1),
(2), (4) Date: Aug. 27, 2013

(87) PCT Pub. No.: WO2012/131882
PCT Pub. Date: Oct. 4, 2012

(65) Prior Publication Data

US 2014/0000496 A1 Jan. 2, 2014

(51) Int. Cl.
*F23G 5/00* (2006.01)
*F23G 5/44* (2006.01)
*F23G 5/50* (2006.01)

(52) U.S. Cl.
CPC ..... *F23G 5/444* (2013.01); *F23G 5/50* (2013.01); *F23G 2205/10* (2013.01); *F23G 2205/121* (2013.01); *F23G 2207/20* (2013.01)

(58) Field of Classification Search
CPC ..... F23G 5/444; F23G 5/446; F23G 5/442; F23G 5/50; C04B 18/023; C04B 28/02;
(Continued)

(56) References Cited

U.S. PATENT DOCUMENTS 4,762,073 A * 8/1988 Giaier ..... F23K 3/00 110/101 CD
5,806,441 A * 9/1998 Chung ..... C09C 1/482 110/108

(Continued)

FOREIGN PATENT DOCUMENTS

EP 1736527 A1 12/2006
JP 56-43103 A 4/1981

(Continued)

OTHER PUBLICATIONS

Horizoe English translation.*

(Continued)

*Primary Examiner* — Jason Lau
(74) *Attorney, Agent, or Firm* — Westerman, Hattori, Daniels & Adrian, LLP

(57) ABSTRACT

A waste material supply device includes a hopper into which a waste material is supplied, a first rubbish supply apparatus having an inlet connected to an outlet of the hopper and a pusher configured to push out the waste material in a horizontal direction, a connecting chute having an upper portion connected to an outlet of the first rubbish supply apparatus to form a space extending upward and downward, and a second rubbish supply apparatus having an inlet connected to a lower portion of the connecting chute and a screw configured to convey the waste material in an axial direction according to rotation about an axis thereof, wherein the first rubbish supply apparatus has a plurality of pushers in a widthwise direction, and each of the pushers is able to be individually manipulated.

2 Claims, 4 Drawing Sheets

(58) Field of Classification Search
CPC ..... C04B 14/106; C04B 14/22; C04B 14/28; C04B 18/06; C04B 18/08; C04B 18/141; C04B 18/167; C04B 22/064; F23K 2201/101; F23K 1/00; C10J 2200/09; C10J 2300/0916; C10J 2300/093; C10J 2300/0946; C10J 2300/0956; C10J 2300/0973; C10J 2300/092; C10J 2300/094; C10J 2300/0943; C10J 2300/0959; C10J 2300/1238; C10J 2300/1606
See application file for complete search history.

(56) References Cited

U.S. PATENT DOCUMENTS

| | | | | |
|---|---|---|---|---|
| 2009/0152073 | A1* | 6/2009 | Fischer ..... | B65G 69/181 198/523 |
| 2009/0173257 | A1 | 7/2009 | Stein | |

FOREIGN PATENT DOCUMENTS

| | | | |
|---|---|---|---|
| JP | 58-108317 | A | 6/1983 |
| JP | 3-99114 | A | 4/1991 |
| JP | 8-28846 | A | 2/1996 |
| JP | 09-170736 | A | 6/1997 |
| JP | 10-019219 | A | 1/1998 |
| JP | 10-253025 | A | 9/1998 |
| JP | 2000-028121 | A | 1/2000 |
| JP | 2001-221419 | A | 8/2001 |
| JP | 2002-181316 | A | 6/2002 |
| JP | 2003-302018 | A | 10/2003 |
| JP | 2007-255816 | A | 10/2007 |
| JP | 2009-126615 | A | 6/2009 |

OTHER PUBLICATIONS

International Search Report of PCT/JP2011/057704, mailing date of Apr. 19, 2011.
Written Opinion of PCT/JP2011/057704, mailing date of Apr. 19, 2011, w/English tranlsation.
Japanese Office Action dated Jun. 3, 2014, issued in Japanese Patent Application No. 2013-506904, w/English translation, (7 pages).
Extended European Search Report dated Sep. 9, 2014, issued in corresponding European Application No. 11862351.1. (6 pages).

* cited by examiner

WASTE MATERIAL SUPPLY DEVICE AND WASTE MATERIAL PROCESSING DEVICE

TECHNICAL FIELD

The present invention relates to a waste material supply device configured to regularly supply a waste material into a waste material heat treatment furnace using a pyrolyzer, an incinerator, or the like, to process a waste material such as municipal waste, industrial waste, or the like, and a waste material processing device including the same.

BACKGROUND ART

A waste material heat treatment furnace such as a pyrolyzer, an incinerator, or the like, configured to process a waste material such as municipal waste or the like is maintained at a certain temperature through heat generation by combustion of the waste material itself to continuously perform the combustion. That is, the waste material is heat-treated using the waste material itself as fuel. For this reason, supply of the waste material largely exceeding the processing capacity of a processing furnace causes the temperature in the furnace to meet or exceed the heat-resistant temperature, which has a negative impact on durability.

In addition, since a supply of waste material largely under the processing capacity of the processing furnace decreases the temperature in the furnace and prevents a self-combustion operation due to the heat of the waste material itself, it is necessary to maintain a temperature at which the combustion continues using a supplementary fuel such as heavy oil or the like. Accordingly, once the processing is started in the waste material heat treatment furnace, it is desirable to regularly maintain the supply of the waste material into the furnace without variation. In addition, while a combustion gas from the combustion furnace is subjected to be purification-processed through a downstream process to be discharged to the atmosphere from a stack, a stable operation in the combustion furnace also contributes performance exhibition in the downstream process.

In the related art, as a supply device of a waste material to a combustion furnace, a waste material supply device constituted by a rubbish supply hopper configured to receive a waste material, a pusher type waste material supply device configured to push out the waste material supplied into the rubbish supply hopper, a connecting chute connected to an outlet of the pusher type waste material supply device, and a screw type waste material supply device is known (for example, see Patent Literature 1). After the waste material is discharged by the pusher type waste material supply device, the waste material supply device performs an operation of securing a waste material amount appropriate for the connecting chute, and reduces the variation in waste material amount discharged from the screw type waste material supply device, enabling stable discharge

CITATION LIST

Patent Literature

[Patent Literature 1]

Japanese Unexamined Patent Application, First Publication No. 2007-255816

SUMMARY OF INVENTION

Technical Problem

However, in the waste material supply device disclosed in Patent Literature 1, there is a case that the waste material supply amount from the pusher type waste material supply device is excessively increased and a storage level in the connecting chute of the upper portion of the screw type waste material supply device becomes unstable, thereby the waste material may be clogged in the connecting chute.

In consideration of the above-mentioned circumstances, an aspect of the present invention is to provide a waste material supply device capable of suppressing a large supply of a waste material discharged from a pusher type waste material supply device, and stably maintaining a waste material storage level of an upper portion of a screw type waste material supply device.

Solution to Problem

In order to accomplish the above-mentioned aspect, the present invention employs the following means.

A waste material supply device according to the present invention includes a hopper into which a waste material is supplied; a first rubbish supply apparatus having an inlet connected to an outlet of the hopper and a pusher configured to push out the waste material in a horizontal direction; a connecting chute having an upper portion connected to an outlet of the first rubbish supply apparatus to form a space extending upward and downward; and a second rubbish supply apparatus having an inlet connected to a lower portion of the connecting chute, and a screw configured to convey the waste material in an axial direction according to rotation about an axis thereof, wherein the first rubbish supply apparatus has a plurality of pushers in a widthwise direction, and each of the pushers is able to be individually manipulated.

According to the waste material supply device of the present invention, the amount of waste material pushed to the connecting chute can be reduced, and a large amount of the waste material being supplied into the connecting chute can be suppressed.

In addition, the waste material supply device of the present invention may further include a level sensor installed at the connecting chute and configured to detect a sediment amount of the waste material accumulated in the connecting chute; and a control device configured to control each of the pushers based on detection level of the level sensor.

According to the waste material supply device of the present invention, the waste material storage amount of the connecting chute can be stably maintained.

In addition, the control device may control the plurality of pushers to advance and retreat at different timings when the detection level of the level sensor arrives at a preset lower limit value.

According to the waste material supply device of the present invention, the waste material can be supplied with good balance.

In addition, the control device may control the pushers to retreat when the detection level of the level sensor arrives at a preset upper limit value.

According to the waste material supply device of the present invention, a large supply of the waste material can be prevented.

In addition, the present invention provides a waste material processing device including a waste material heat treatment furnace configured to receive the waste material supplied from the waste material supply device and combustion-process the waste material, wherein the control device adjusts the number of revolutions of the screw of the second rubbish supply apparatus such that the waste material is constantly supplied into the waste material heat treatment furnace according to a diminution rate of the detection level detected by the level sensor.

According to the waste material processing device of the present invention, supply of the waste material into the waste material heat treatment furnace can be maintained in a stable state in which a temporal change is small.

Advantageous Effects of Invention

According to the waste material supply device of the present invention, an amount of waste material pushed out to the connecting chute can be reduced, and the supply of large of waste material amount to the connecting chute can be suppressed.

MODES FOR CARRYING OUT THE INVENTION

Figure 1:
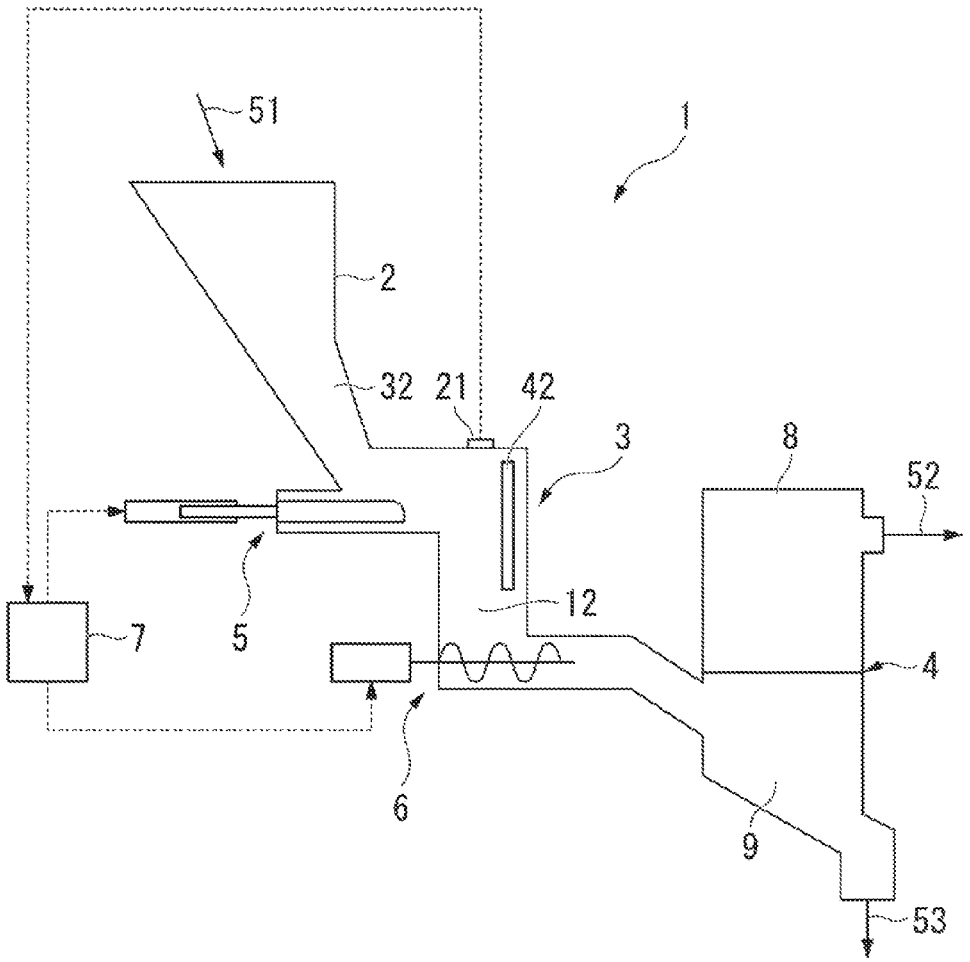
FIG. 1 is a schematic configuration view of a waste material processing device including a waste material supply device of an embodiment of the present invention.

Hereinafter, an embodiment of the present invention will be described in detail with reference to the accompanying drawings. FIG. 1 is a schematic view of a waste material processing device 1 including a waste material supply device 3 of the embodiment.

As shown in FIG. 1, the waste material processing device 1 of the embodiment includes a rubbish supply hopper 2 to which a waste material 51 is supplied into an upper portion thereof, a waste material supply device 3 connected to an outlet of the rubbish supply hopper 2, and a gasification furnace 4 connected to an outlet of the waste material supply device 3.

The gasification furnace 4 has a gasification furnace main body 8, and a flow sand layer 9 installed at a lower portion of the gasification furnace main body 8. In order to form the flow sand layer 9, air for primary combustion is blown from a lower side, and sand is fluidized as a bed material, which is a transmission medium of heat.

The waste material input into the gasification furnace 4 is dried and pyrolyzed in the flow sand layer 9. Here, non-combustibles 53 are discharged with the fluidized sand. The waste material is decomposed into a gas, tar, and char (carbide) by pyrolysis. The tar is present in a liquid phase at a normal temperature but present in a gaseous phase in the gasification furnace. The char is gradually pulverized in the flow sand layer 9 of the gasification furnace 4, and introduced into a cyclone melting furnace (not shown) as a pyrolysis gas 52 together with the gas and tar.

The waste material supply device 3 has a pusher type rubbish supply apparatus 5 configured to push out a waste material supplied from the rubbish supply hopper 2, a connecting chute 12 into which the waste material pushed out of the pusher type rubbish supply apparatus 5 is input, and a screw type rubbish supply apparatus 6 installed at a lower portion of the connecting chute 12 and configured to discharge the waste material stored in the connecting chute 12 to the gasification furnace 4. In addition, the waste material supply device 3 includes a level sensor 21 configured to detect a sediment amount of the waste material stored in the connecting chute 12. The sediment amount detected by the level sensor 21 is transmitted to a control device 7, and the control device 7 controls the pusher type rubbish supply apparatus 5 and the screw type rubbish supply apparatus 6 according to the sediment amount. A control method will be described below.

Figure 2:
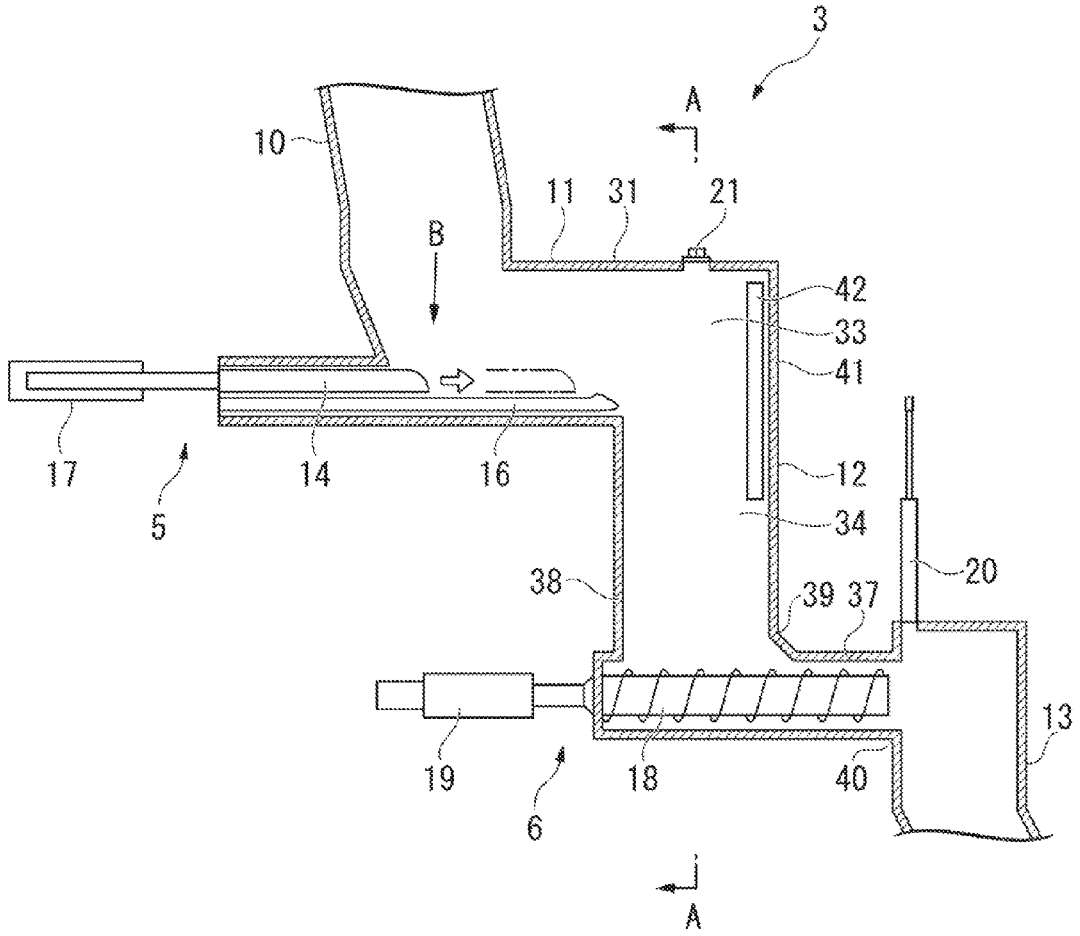
FIG. 2 is a schematic side view of the waste material supply device of the embodiment of the present invention.
Figure 3:
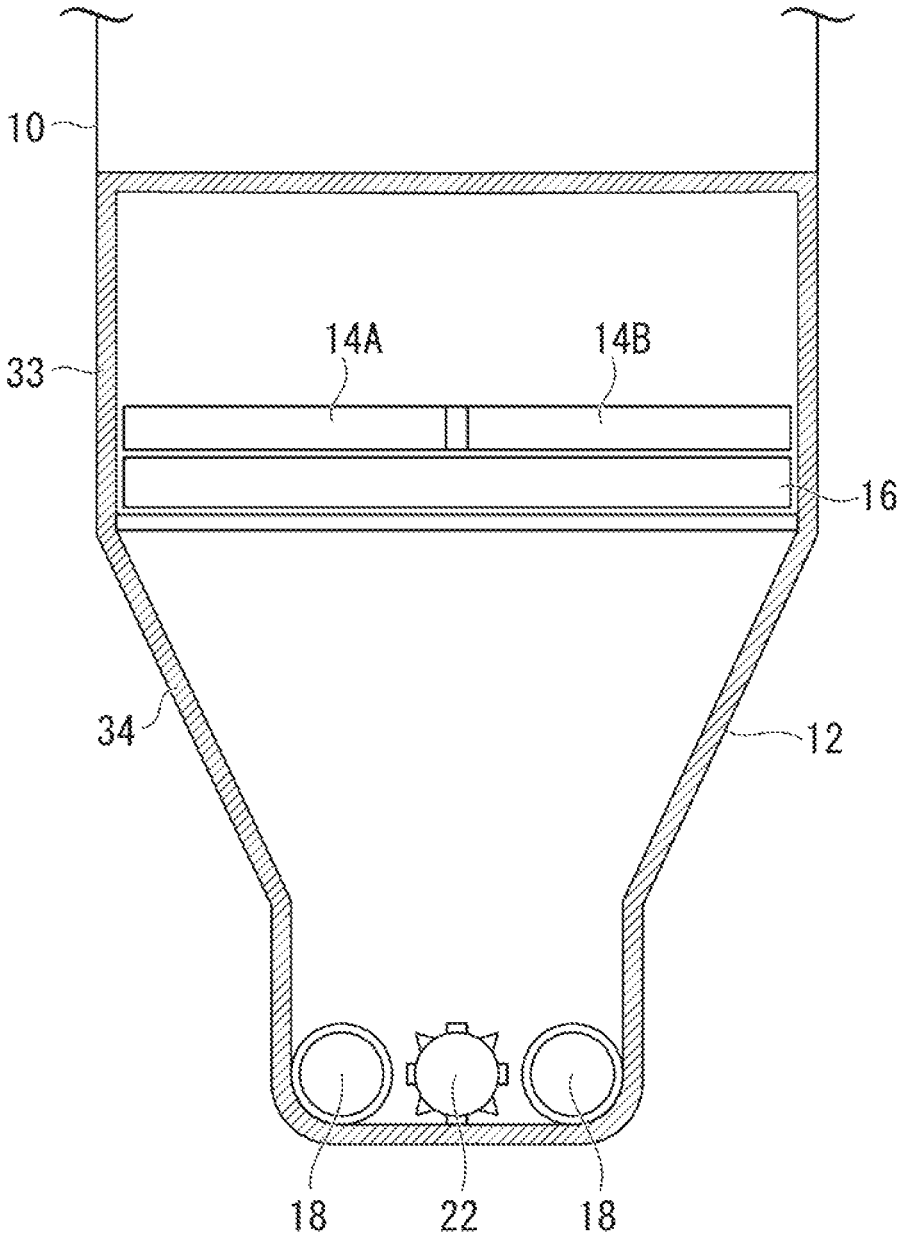
FIG. 3 is a cross-sectional view of the waste material supply device taken along line A-A of FIG. 2.
Figure 4:
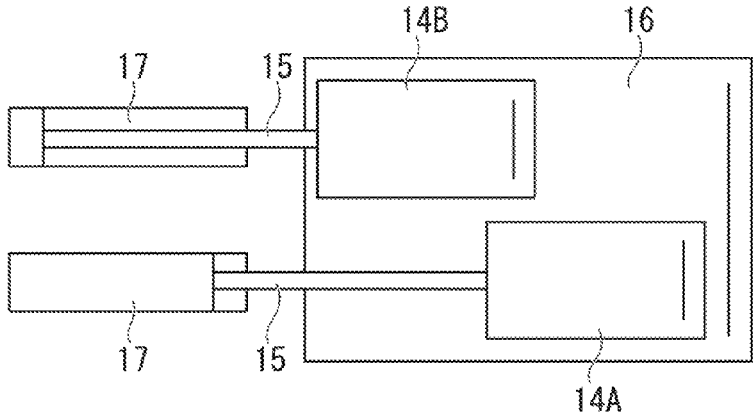
FIG. 4 is a view when seen in a direction of an arrow B of FIG. 2.

Next, based on FIGS. 2 to 4, the waste material supply device 3 of the embodiment will be described in detail.

The pusher type rubbish supply apparatus 5 includes a pusher 14 having a rectangular parallelepiped shape enlarged in a horizontal direction, a hydraulic cylinder 17 configured to slidably drive the pusher 14, and a feed table 16 horizontally enlarged within a moving range of the pusher 14 to support the pusher 14 from a lower surface side of the pusher 14.

Hereinafter, an advance direction of a slide direction of the pusher 14 (a right side of FIG. 2) is referred to as a forward direction, and a retreat direction is referred to as a rearward direction. In addition, these are collectively referred to as a front-back direction, and a horizontal direction perpendicular to the front-back direction is referred to as a widthwise direction (leftward and rightward directions in FIG. 3).

The pusher 14 is divided into a first pusher 14A and a second pusher 14B. A divided surface is disposed at a center in the widthwise direction of the pusher perpendicular to the forward and rearward directions of the pusher 14, and formed in the forward and rearward directions. The hydraulic cylinder 17 is individually installed at each of the pushers 14A and 14B.

The pusher type rubbish supply apparatus 5 includes a casing 11 configured to cover the pusher 14 from upper and side surfaces thereof. The casing 11 has an inlet 10 connected to an outlet of the rubbish supply hopper 2, and an outlet 31 formed at one end in the slide direction of the pusher 14. In addition, upper and lower spaces of the casing 11 and the pusher 14 have sizes substantially equal to a cross-sectional space of a lower section 32 (see FIG. 1) of the rubbish supply hopper 2.

The connecting chute 12 is formed to extend downward from the outlet 31 of the pusher type rubbish supply apparatus 5. The connecting chute 12 is constituted by an upper portion 33 and a lower portion 34. The upper portion 33 has a rectangular parallelepiped shape in which a space of the outlet 31 of the pusher type rubbish supply apparatus 5 extends forward. The lower portion 34 has a shape that is constant in the front-back direction and narrows toward the center thereof in the widthwise direction.

The level sensor 21 configured to measure a storage amount of the waste material is installed at an upper surface of the connecting chute 12. The level sensor 21 is, for example, an ultrasonic type sensor, and measures a height (the storage amount) of the waste material by irradiating the waste material with ultrasonic waves from above. Accordingly, the waste material can be measured in a non-contact manner.

In addition, a bridge removing apparatus 42 is installed inside a wall section 41 in front of the casing 11. The bridge removing apparatus 42 is formed of a thin rectangular parallelepiped member, which is driven by a hydraulic cylinder (not shown) to be moved upward and downward along the wall section 41. Further, the above-mentioned bridge removing apparatus 42 may be installed at a front wall section of the rubbish supply hopper 2.

The bridge removing apparatus 42 may be manually moved while being viewed with the naked eye, or a bridge may be automatically operated while installing a detection sensor.

An outlet 38 disposed at a bottom section of the connecting chute 12 is connected to an inlet 39 of the screw type rubbish supply apparatus 6. The screw type rubbish supply apparatus 6 includes two supply screws 18 and 18 disposed such that axes thereof are parallel to each other under the inlet 39. The supply screw 18 is formed by winding and attaching a band-shaped member on an outer circumference of a rod body or a cylindrical body. The screw type rubbish supply apparatus 6 is configured to rotate the supply screw 18 and convey the waste material in an axial direction according to the rotation about the axis.

A rod type paddle 22 is installed between the supply screws 18 and 18. The rod type paddle 22 is formed by a plurality of rods protruding from an outer circumference of an axis of a rod body or a cylindrical body at predetermined pitches in a circumferential direction. The rod type paddle 22 and the supply screws 18 are disposed such that shaft centers thereof are parallel to each other.

The two supply screws 18 and 18 are rotated by a driving motor 19. A driving force of the driving motor 19 is transmitted to the supply screw 18 by a transmission unit (not shown) such as a chain/sprocket, a gear, or the like. The transmission unit is set to rotate the two supply screws 18 and 18 in opposite directions. In addition, the rod type paddle 22 is also driven by a hydraulic pressure as will be described below. The rod type paddle 22 is set to repeat normal and reverse rotations.

Further, the screw type rubbish supply apparatus 6 includes a casing 37. The casing 37 covers both of the supply screw 18 and the rod type paddle 22, has the inlet 39 connected to the outlet 38 of the connecting chute 12, and forms an outlet 40 in front of ends of both of the supply screw 18 and the rod type paddle 22.

A passage 13 is connected from the outlet 40 of the screw type rubbish supply apparatus 6 to the gasification furnace 4. In addition, a slide gate 20 is installed at the outlet 40 side of the screw type rubbish supply apparatus 6. The slide gate 20 is a gate configured to cover the outlet 40 when the waste material is not supplied to the gasification furnace 4 in a state in which the waste material supply device 3 is stopped, and to open the outlet 40 when the waste material is supplied.

Figure 5:
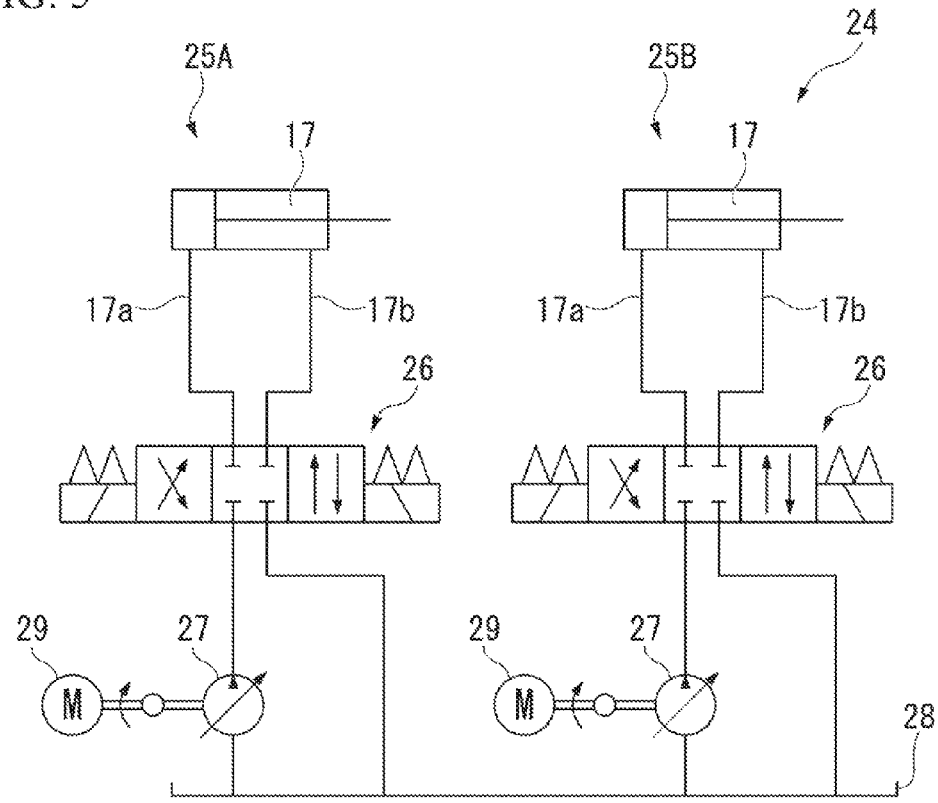
FIG. 5 is a schematic diagram of a hydraulic system.

Next, a hydraulic system 24 configured to operate the hydraulic cylinder 17 will be described with reference to a circuit diagram of FIG. 5. As shown in FIG. 5, the hydraulic system 24 includes a first driving system 25A configured to drive the first pusher 14A, a second driving system 25B configured to drive the second pusher 14B, and an oil tank 28 configured to store a hydraulic oil used in the first driving system 25A and the second driving system 25B. Since the first driving system 25A and the second driving system 25B have the same configuration, only the first driving system 25A will be described here.

The first driving system 25A is a standard hydraulic pressure system constituted by the hydraulic cylinder 17 having the first pusher 14A to which a rod is connected, a solenoid operated control valve 26 connected to two ports 17*a* and 17*b* of the hydraulic cylinder 17, a hydraulic pressure pump 27 configured to supply a hydraulic oil into the hydraulic cylinder 17, a motor 29 configured to drive the hydraulic pressure pump, and a filter, a relief valve, and so on, which are not shown.

In the hydraulic cylinder 17, the hydraulic oil is supplied by the hydraulic pressure pump 27 driven by the motor 29, and forward and rearward movement of the pusher 14 can be controlled as the solenoid operated control valve 26 is manipulated by the control device 7.

As described above, the driving systems are individually installed at the two pushers 14A and 14B and can individually control forward and rearward movement of the pushers 14A and 14B.

In addition, the hydraulic cylinder configured to drive the above-mentioned rod type paddle 22, the bridge removing apparatus 42 and the slide gate 20 is also driven by the same driving system sharing the oil tank 28.

Further, these driving sources are not limited to the hydraulic cylinder, and a pneumatic cylinder, an electric cylinder, or the like, may be employed as long as the pusher 14 can be linearly moved in a sufficient stroke. In addition, the driving sources may be configured by assembling gears or the like configured to convert a rotational motion with respect to a rotary motor into a linear motion.

The control device 7 (see FIG. 1) is configured to control operations of the pusher type rubbish supply apparatus 5 and the screw type rubbish supply apparatus 6 according to an input from the level sensor 21. The level sensor 21 is configured to detect a sediment amount of the waste material accumulated in the connecting chute 12.

The control device 7 is set to drive the pusher type rubbish supply apparatus 5 when a level detected by the level sensor 21 (the sediment amount of the waste material) arrives at a preset first predetermined level (a lower limit value), for example, 1,000 mm or less. Here, the control device 7 transmits a command signal to advance or retreat the first pusher 14A and the second pusher 14B while maintaining predetermined intervals. That is, the first pusher 14A and the second pusher 14B are controlled to be moved forward and rearward at different timings so that they are not simultaneously moved forward and rearward.

In addition, the control device 7 transmits a command signal to forcedly retreat the first pusher 14A and the second pusher 14B when the detected level arrives at a second predetermined level (an upper limit value), for example, 1,500 mm, which is higher than the first predetermined level, which is preset. Accordingly, the waste material is not supplied from the pusher type rubbish supply apparatus 5 to the connecting chute 12.

The predetermined level of the waste material in the connecting chute 12 may be set in consideration of the intention that supply of the waste material into the screw type rubbish supply apparatus 6 not be interrupted and the intention that a high temperature gas does not easily approach the waste material level sensor 21 from the gasification furnace side.

In addition, the control device 7 observes a diminution rate of the waste material stored in the connecting chute 12 by measuring a level continuously detected by the level sensor 21. The control device 7 has a function of adjusting the number of revolutions of the supply screw 18 of the screw type rubbish supply apparatus 6 according to the diminution rate. The control device 7 performs controls such that reducing the number of revolutions of the supply screw 18 when the diminution rate exceeds a predetermined diminution rate, for example, 100 mm/min, or suppressing an increase in the number of revolutions of the supply screw 18 when lower than the predetermined diminution rate.

Next, operations of the waste material supply device 3 and the waste material processing device 1 including the waste material supply device 3 of the embodiment will be described.

First, as shown in FIG. 1, the waste material 51 is supplied from the rubbish supply hopper 2, and the waste material flows into the connecting chute 12 via the casing 11. The waste material is wound into a screw groove of the supply screw 18 of the screw type rubbish supply apparatus 6 to be conveyed to the gasification furnace 4. In addition, a large waste material is crushed by rotation in normal and reverse directions of the rod type paddle 22 or shredded by a tearing operation to be conveyed.

When the level sensor 21 detects that the storage amount of the waste material in the connecting chute 12 is equal to or lower than the first predetermined level, the control device 7 operates the pusher type rubbish supply apparatus 5. Here, the first pusher 14A and the second pusher 14B repeatedly alternate between advancing and retreating, and the waste material is pushed out of the connecting chute 12.

In addition, when the level sensor 21 detects that the storage amount of the waste material in the connecting chute 12 has arrived at the second predetermined level, the control device 7 forcedly retreats the pusher 14 of the pusher type rubbish supply apparatus 5, and push-out of the waste material to the connecting chute 12 is stopped.

Further, in the case in which the storage amount is disposed between the first predetermined level and the second predetermined level, when the diminution rate of the waste material is the predetermined speed or more, the supply screw 18 is decelerated, and when the diminution rate is the predetermined speed or less, the supply screw 18 is accelerated.

According to the embodiment, as the pusher 14 of the pusher type rubbish supply apparatus 5 is configured to be divided into two parts and individually manipulated, the amount of waste material pushed out to the connecting chute 12 can be reduced.

In addition, as each of the pushers 14A and 14B is individually controlled based on the information of the level sensor 21, the waste material storage amount of the connecting chute 12 can be more stably maintained.

Further, as the number of revolutions of the supply screw 18 of the screw type rubbish supply apparatus 6 is adjusted based on the diminution rate of the detection level detected by the level sensor 21, supply of the waste material into the gasification furnace 4 can be maintained in a stable state in which the temporal change is small. Accordingly, the combustion state of the gasification furnace 4 and further the exhaust gas processing state, which is a post-process, can be stabilized, and sufficient performance can be exhibited.

In addition, the technical scope of the present invention is not limited to the above-mentioned embodiment but various modifications may be made without departing from the scope of the present invention. For example, in the embodiment, while the pusher of the pusher type rubbish supply apparatus is divided into two parts in the widthwise direction, the dividing is not limited thereto and the pusher may be divided into three parts in the widthwise direction to further reduce the amount of waste material pushed out per unit time.

REFERENCE SIGNS LIST

1 waste material processing device
2 rubbish supply hopper (hopper)
3 waste material supply device
4 gasification furnace (waste material heat treatment furnace)
5 pusher type rubbish supply apparatus (first rubbish supply apparatus)
6 screw type rubbish supply apparatus (second rubbish supply apparatus)
7 control device
10 inlet
12 connecting chute
14 pusher
21 level sensor
31 outlet
39 inlet
51 waste material

The invention claimed is:

1. A waste material supply device comprising:

a hopper into which a waste material is supplied;

a first rubbish supply apparatus having an inlet connected to an outlet of the hopper and pushers configured to push out the waste material in a horizontal direction;

a connecting chute having an upper portion connected to an outlet of the first rubbish supply apparatus to form a space extending upward and downward;

a second rubbish supply apparatus having an inlet connected to a lower portion of the connecting chute, and a screw configured to convey the waste material in an axial direction according to rotation about an axis thereof;

a level sensor installed at the connecting chute and configured to detect a sediment amount of the waste material accumulated in the connecting chute; and a control device configured to control each of the pushers according to a detection level of the level sensor, wherein the first rubbish supply apparatus has a plurality of pushers in a widthwise direction, and each of the pushers is capable of being individually manipulated, the control device controls the plurality of pushers to advance and retreat at different timings and to alternate repeatedly between advancing and retreating when the detection level of the level sensor arrives at a preset lower limit value, and to retreat when the detection level of the level sensor arrives at a preset upper limit value, when the detection level of the level sensor is between the preset upper limit value and the preset lower limit value, the number of revolutions of the screw of the second rubbish supply apparatus is adjusted such that the number of revolutions of the screw is reduced when the diminution rate of the detection level of the level sensor exceeds a predetermined diminution rate and the number of revolutions of the screw is increased when the diminution rate of the detection level of the level sensor is lower than the predetermined diminution rate, and the pushers are not controlled to advance at the same time and are not controlled to retreat at the same time.

2. A waste material processing device comprising:

the waste material supply device according to claim 1; and a waste material heat treatment furnace configured to receive the waste material supplied from the waste material supply device and perform a combustion-process on the waste material, wherein the control device adjusts the number of revolutions of the screw of the second rubbish supply apparatus such that the waste material is constantly supplied into the waste material heat treatment furnace according to a diminution rate of the detection level detected by the level sensor.

* * * * *